US005668927A

United States Patent [19]

Chan et al.

[11] Patent Number: 5,668,927

[45] Date of Patent: Sep. 16, 1997

[54] METHOD FOR REDUCING NOISE IN SPEECH SIGNALS BY ADAPTIVELY CONTROLLING A MAXIMUM LIKELIHOOD FILTER FOR CALCULATING SPEECH COMPONENTS

[75] Inventors: Joseph Chan, Tokyo; Masayuki Nishiguchi, Kanagawa, both of Japan

[73] Assignee: Sony Corporation, Tokyo, Japan

[21] Appl. No.: 431,746

[22] Filed: May 1, 1995

[30] Foreign Application Priority Data

May 13, 1994 [JP] Japan ..... 6-099869

[51] Int. Cl.$^6$ ..... G10L 5/06

[52] U.S. Cl. ..... 704/240; 704/214

[58] Field of Search ..... 395/2.09, 2.1, 395/2.14, 2.17, 2.19, 2.2, 2.23, 2.24, 2.25, 2.35, 2.36, 2.37, 2.4, 2.42, 2.45, 2.46, 2.48, 2.49

[56] References Cited

U.S. PATENT DOCUMENTS 5,036,540 7/1991 Eastmond ..... 395/2.35

OTHER PUBLICATIONS

T. Parsons, "Voice and Speech Processing," 1987, pp. 170–175, 219–222, 345–353, 362.

J.R. Deller et al., "Discrete-Time Processing of Speech Signals," 1987, pp. 506–516.

S. Furui, "Digital Speech Processing, Synthesis, and Recognition," 1989, pp. 91–98.

L.R. Rabiner, "Digital Processing of Speech Signals," 1978, pp. 158–161.

Boll, "Suppression of Acoustic Noise in Speech Using Spectral Subtraction," IEEE Trans. on Acoustics, Speech, and Signal Processing, 27(2):113–120, Apr. 1979.

G. Whipple, "Low Residual Noise Speech Enhancement Utilizing Time-Frequency Filtering," ICASSP-94, Apr. 19–22, 1994, pp. 5–8.

M. Nishiguchi, "Vector Quantized MBE with Simplified V/UV Division at 3.0 kbps," ICASSP-93, Apr. 27–30, 1993, pp. 151–154.

M.S. Ahmed, "Comparison of Noisy Speech Enhancement Algorithms in Terms of LPC Perturbation," IEEE Trans. on Acoustics, Speech, and Signal Processing, 37(1):121–125, Jan. 1989.

*Primary Examiner*—Allen R. MacDonald
*Assistant Examiner*—Susan Wieland
*Attorney, Agent, or Firm*—Jay H. Maioli

[57] ABSTRACT

A noise reducing method for speech signals is provided in which the probability of speech occurring is calculated by spectral subtraction of subtracting the estimated noise spectrum from the spectrum of the input signal, and the maximum likelihood filter is adaptively controlled based upon the calculated speech occurrence probability. Adjustment to an optimum suppression factor may be achieved depending on the SNR of the input speech signal, so that is it unnecessary for the user to effect adjustment prior to practical application. In addition, a method for detecting the noise domain is provided in which the value th employed for finding the threshold value $Th_1$ for noise domain discrimination is calculated using the RMS value of the current frame or the value th of the previous frame multiplied by the coefficient α, whichever is smaller, and the coefficient α is changed over depending on the RMS value of the current frame. Noise domain discrimination by an optimum threshold value responsive to the input signal may be achieved without producing mistaken judgement even on the occasion of noise level fluctuations.

7 Claims, 9 Drawing Sheets

METHOD FOR REDUCING NOISE IN SPEECH SIGNALS BY ADAPTIVELY CONTROLLING A MAXIMUM LIKELIHOOD FILTER FOR CALCULATING SPEECH COMPONENTS

BACKGROUND OF THE INVENTION

This invention relates to a method for reducing the noise in speech signals and a method for detecting the noise domain. More particularly, it relates to a method for reducing the noise in the speech signals in which noise suppression is achieved by adaptively controlling a maximum likelihood filter for calculating speech components based upon the speech presence probability and the SN ratio calculated on the basis of input speech signals, and a noise domain detection method which may be conveniently applied to the noise reducing method.

In a portable telephone or speech recognition system, it is thought to be necessary to suppress environmental noise or background noise contained in the collected speech signals and to enhance the speech components.

As techniques for enhancing the speech or reducing the noise, those employing a conditional probability function for adjusting attenuation factor are shown in R. J. McAulay and M. L. Malpass, Speech Enhancement Using a Soft-Decision Noise Suppression Filter, IEEE Trans. Acoust, Speech, Signal Processing, Vol.28, pp.137–145, April 1980, and J. Yang, Frequency Domain Noise Suppression Approach in Mobile Telephone System, IEEE ICASSP, vol.II, pp. 363–366, April 1993.

With these noise suppression techniques, it may occur frequently that unnatural speech tone or distorted speech be produced due to the operation based on an inappropriate fixed signal-to-noise (S/N) ratio or to an inappropriate suppression factor. In actual application, it is not desirable for the user to adjust the S/N ratio, which is among the parameters of the noise suppression system for achieving an optimum performance. In addition, it is difficult with the conventional speech signal enhancement techniques to remove the noise sufficiently without by-producing the distortion of the speech signals susceptible to considerable fluctuations in the short-term S/N ratio.

With the above-described speech enhancement or noise reducing method, the technique of detecting the noise domain is employed, in which the input level or power is compared to a pre-set threshold for discriminating the noise domain. However, if the time constant of the threshold value is increased for preventing tracking to the speech, it becomes impossible to follow noise level changes, especially to increase in the noise level, thus leading to mistaken discrimination.

SUMMARY OF THE INVENTION

In view of the foregoing, it is an object of the present invention to provide a method for reducing the noise in speech signals whereby the suppression factor is adjusted to a value optimized with respect to the S/N ratio of the actual input responsive to the input speech signals and sufficient noise removal may be achieved without producing distortion as secondary effect or without the necessity of pre-adjustment by the user.

It is another object of the present invention to provide a method for detecting the noise domain whereby noise domain discrimination may be achieved based upon an optimum threshold value responsive to the input signal and mistaken discrimination may be eliminated even on the occasion of noise level fluctuations.

In one aspect, the present invention provides a method shown in FIG. 7 for reducing the noise in an input speech signal in which noise suppression is done by adaptively controlling a maximum likelihood filter adapted for calculating speech components based on the speech presence probability and the S/N ratio calculated 32 based on the input speech signal 32. Specifically, the spectral difference, that is, the spectrum of an input signal 30 less an estimated noise spectrum, is employed in calculating the probability of speech occurrence 36.

Preferably, as shown in FIG. 8, the value of the above spectrum difference or a pre-set value, whichever is larger, is employed for calculating the probability of speech occurrence. Preferably, the value of the above difference 42 or a pre-set value, whichever is larger, is calculated for the current frame and for a previous frame 42, the value for the previous frame is multiplied with a pre-set decay coefficient 46, and the value for the current frame or the value for the previous frame multiplied by a pre-set decay coefficient, whichever is larger, is employed for calculating the speech presence probability 48.

The characteristics of the maximum likelihood filter are processed with smoothing filtering along the frequency axis or along the time axis. Preferably, a median value of characteristics of the maximum likelihood filter in the frequency range under consideration and characteristics of the maximum likelihood filter in neighboring left and right frequency ranges is used for smoothing filtering along the frequency axis.

In another aspect, shown in FIG. 9, the present invention provides a method for detecting a noise domain by dividing an input speech signal on the frame basis, finding an RMS value on the frame basis and comparing the RMS values to a threshold value $Th_1$ 54 for detecting the noise domain. Specifically, a value th for finding the threshold $Th_1$ 52 is calculated using the RMS value for the current frame and a value th of the previous frame multiplied by a coefficient $\alpha$, whichever is smaller, and the coefficient $\alpha$ is changed over depending on an RMS value of the current frame 50. In the following embodiment, the threshold value $Th_1$ is $NoiseRMS_{thres}[k]$, while the value th for finding it is $MinNoise_{short}[k]$, $\underline{k}$ being a frame number. As will be explained in the equation (7), the value of the previous frame $MinNoise_{short}[k-1]$ multiplied by the coefficient $\alpha[k]$ is compared to the RMS value of the current frame RMS[k] of the current frame and a smaller value of the two is set to $MinNoise_{short}[k]$. The coefficient[k] is changed over from 1 to 0 or vice versa depending on the RMS value RMS[k].

Preferably, the value th for finding the threshold $Th_1$ may be a smaller one of the RMS value for the current frame and a value th of the previous frame multiplied by a coefficient $\alpha$, that is $MinNoise_{short}[k]$ as later explained, or the smallest RMS value over plural frames, that is $MinNoise_{long}[k]$, whichever is larger.

Also, the noise domain is detected based upon the results of discrimination of the relative energy of the current frame using the threshold value $Th_2$ calculated using the maximum SN ratio of the input speech signal and the results of comparison of the RMS value to the threshold value $Th_1$. In the following embodiment, the threshold value $Th_2$ is $dBthres_{rel}[k]$, with the frame-based relative energy being $dB_{rel}$. The relative energy $dB_{rel}$ is a relative value with respect to a local peak of the directly previous signal energy and describes the current signal energy.

The above-described noise domain detection method is preferably employed in the noise reducing method for speech signals according to the present invention.

With the noise reducing method for speech signals according to the present invention, since the speech presence probability is calculated by spectral subtraction of subtracting the estimated noise spectrum from the spectrum of the input signal, and the maximum likelihood filter is adaptively controlled based upon the calculated speech presence probability, adjustment to an optimum suppression factor may be achieved depending on the SNR of the input speech signal, so that it is unnecessary for the user to effect adjustment prior to practical application.

In addition, with the method for detecting the noise domain according to the present invention, since the value th employed for finding the threshold value $Th_1$ for noise domain discrimination is calculated using the RMS value of the current frame or the value th of the previous frame multiplied by the coefficient α, whichever is smaller, and the coefficient α is changed over depending on the RMS value of the current frame, noise domain discrimination by an optimum threshold value responsive to the input signal may be achieved without producing mistaken judgement even on the occasion of noise level fluctuations.

DETAILED DESCRIPTION OF THE PREFERRED EMBODIMENT

Figure 1:
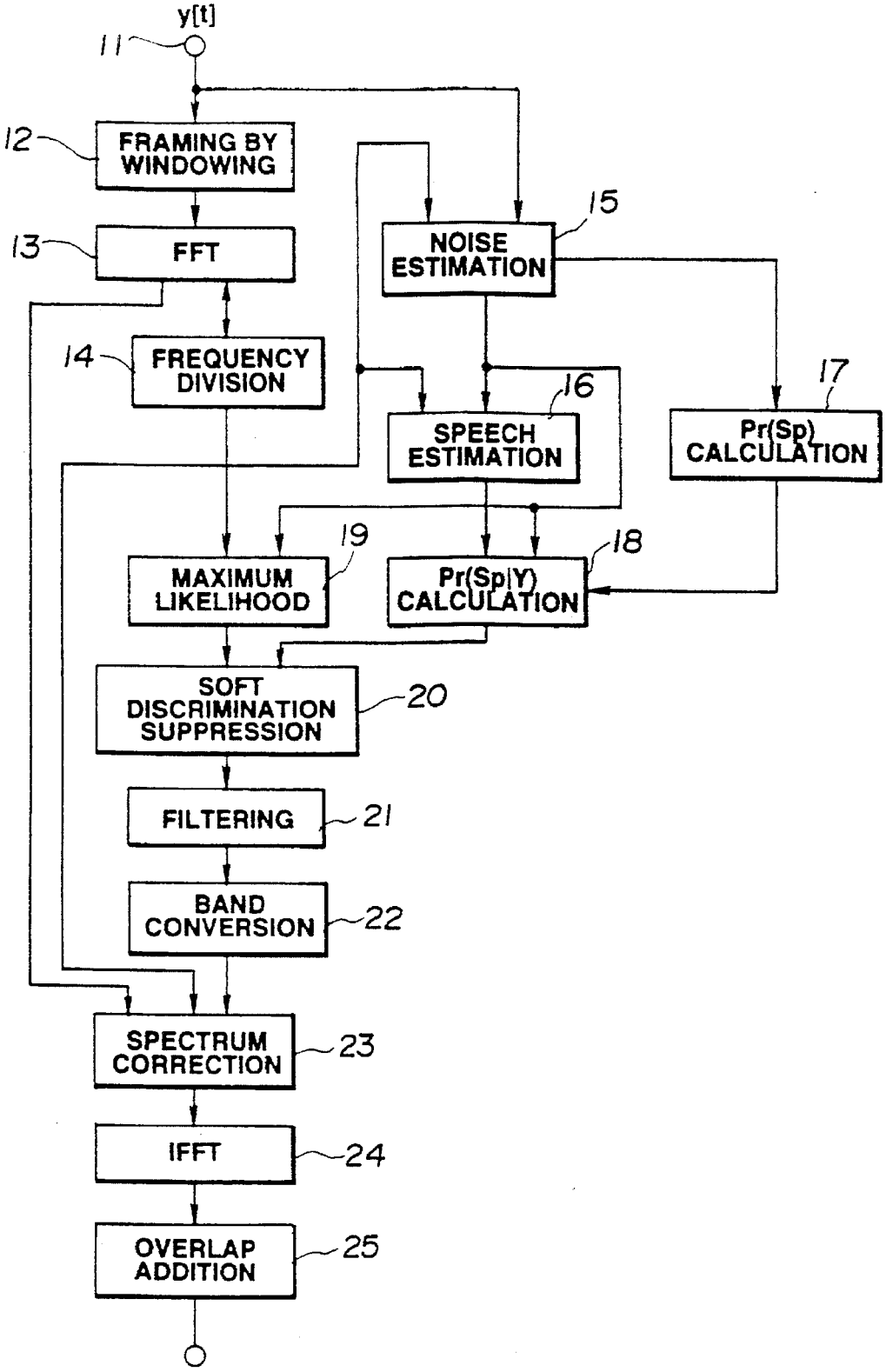
FIG. 1 is a block circuit diagram for illustrating a circuit arrangement for carrying out the noise reducing method for speech signals according to an embodiment of the present invention.

Referring to the drawings, a preferred illustrative embodiment of the noise reducing method for speech signals according to the present invention is explained in detail.

In FIG. 1, a schematic arrangement of the noise reducing device for carrying out the noise reducing method for speech signals according to the preferred embodiment of the present invention is shown in a block circuit diagram.

Referring to FIG. 1, an input signal y[t] containing a speech component and a noise component is supplied to an input terminal 11. The input signal y[t], which is a digital signal having the sampling frequency of FS, is fed to a framing/windowing circuit 12 where it is divided into frames each having a length equal to FL samples so that the input signal is subsequently processed on the frame basis. The framing interval, which is the amount of frame movement along the time axis, is FI samples, such that the (k+1)th sample is started after FL samples as from the K'th frame. Prior to processing by a fast Fourier transform (FFT) circuit 13, the next downstream side circuit, the framing/windowing circuit 12 preforms windowing of the frame-based signals by a windowing function $W_{input}$. Meanwhile, after inverse FFT or IFFT at the final stage of signal processing of the frame-based signals, an output signal is processed by windowing by a windowing function $W_{output}$. Examples of the windowing functions $W_{input}$ and $W_{output}$ are given by the following equations (1) and (2):

$$W_{input}[j] = \left(\frac{1}{2} - \frac{1}{2}\cdot\cos\left(\frac{2\cdot\pi\cdot j}{FL}\right)\right)^{\frac{1}{4}} \quad (1)$$

$$0 \leqq j \leqq FL$$

$$W_{output}[j] = \left(\frac{1}{2} - \frac{1}{2}\cdot\cos\left(\frac{2\cdot\pi\cdot j}{FL}\right)\right)^{\frac{3}{4}} \quad (2)$$

$$0 \leqq j \leqq FL$$

If the sampling frequency FS is 8000 Hz=8 kHz, and the framing interval FI is 80 and 160 samples, the framing interval is 10 msec and 20 msec, respectively.

The FFT circuit 13 performs FFT at 256 points to produce frequency spectral amplitude values which are divided by a frequency dividing circuit 14 into e.g., 18 bands. The following Table 1 shows examples of the frequency ranges of respective bands.

TABLE 1

| Band Number | Frequency Ranges |
|---|---|
| 0 | 0–125 Hz |
| 1 | 125–250 Hz |
| 2 | 250–375 Hz |
| 3 | 375–563 Hz |
| 4 | 563–750 Hz |
| 5 | 750–938 Hz |
| 6 | 938–1125 Hz |
| 7 | 1125–1313 Hz |
| 8 | 1313–1563 Hz |
| 9 | 1563–1813 Hz |
| 10 | 1813–2063 Hz |
| 11 | 2063–2313 Hz |
| 12 | 2313–2563 Hz |
| 13 | 2563–2813 Hz |
| 14 | 2813–3063 Hz |
| 15 | 3063–3375 Hz |
| 16 | 3375–3688 Hz |
| 17 | 3688–4000 Hz |

These frequency bands are set on the basis of the fact that the perceptive resolution of the human auditory system is lowered towards the higher frequency side. As the amplitudes of the respective ranges, the maximum FFT amplitudes in the respective frequency ranges are employed.

A noise estimation circuit 15 distinguishes the noise in the input signal y[t] from the speech and detects a frame which is estimated to be the noise. The operation of estimating the noise domain or detecting the noise frame is performed by combining three kinds of detection operations. An illustrative example of noise domain estimation is hereinafter explained by referring to FIG. 2.

In this figure, the input signal y[t] entering the input terminal 11 is fed to a root-mean-square value (RMS) calculating circuit 15A where short-term RMS values are calculated on the frame basis. An output of the RMS calculating circuit 15A is supplied to a relative energy calculating circuit 15B, a minimum RMS calculating circuit 15C, a maximum signal calculating circuit 15D and a noise spectrum estimating circuit 15E. The noise spectrum estimating circuit 15E is fed with outputs of the relative energy calculating circuit 15B, minimum RMS calculating circuit 15C and the maximum signal calculating circuit 15D, while being fed with an output of the frequency dividing circuit 14.

The RMS calculating circuit 15A calculates RMS values of the frame-based signals. The RMS value RMS[k] of the k'th frame is calculated by the following equation:

$$\mathrm{RMS}[k]=\sqrt{\frac{1}{FL}\cdot\sum_{t=1}^{FL}y^2[t]} \tag{3}$$

The relative energy calculating circuit 15B calculates the relative energy $dB_{rel}[k]$ of the k'th frame pertinent to the decay energy from a previous frame. The relative energy $dB_{rel}[k]$ in dB is calculated by the following equation (4):

$$dB_{rel}[k]=10\log_{10}\left(\frac{E_{decay}[k]}{E[k]}\right) \tag{4}$$

In the above equation (4), the energy value E[k] and the decay energy value $E_{decay}[k]$ may be found respectively by the equations (5) and (6):

$$E[k]=\sum_{t=1}^{FL}y^2[t] \tag{5}$$

$$E_{decay}[k]=\max\left(E[k],e^{\frac{-FL}{0.65\cdot FS}}E_{decay}[k-1]\right) \tag{6}$$

Sine the equation (5) may be represented by FL·(RMS[k])$^2$, an output RMS[k] of the RMS calculating circuit 15A may be employed. However, the value of the equation (5), obtained in the course of calculation of the equation (3) in the RMS calculating circuit 15A, may be directly transmitted to the relative energy calculating circuit 15B. In the equation (6), the decay time is set to 0.65 sec only by way of an example.

Figure 3:
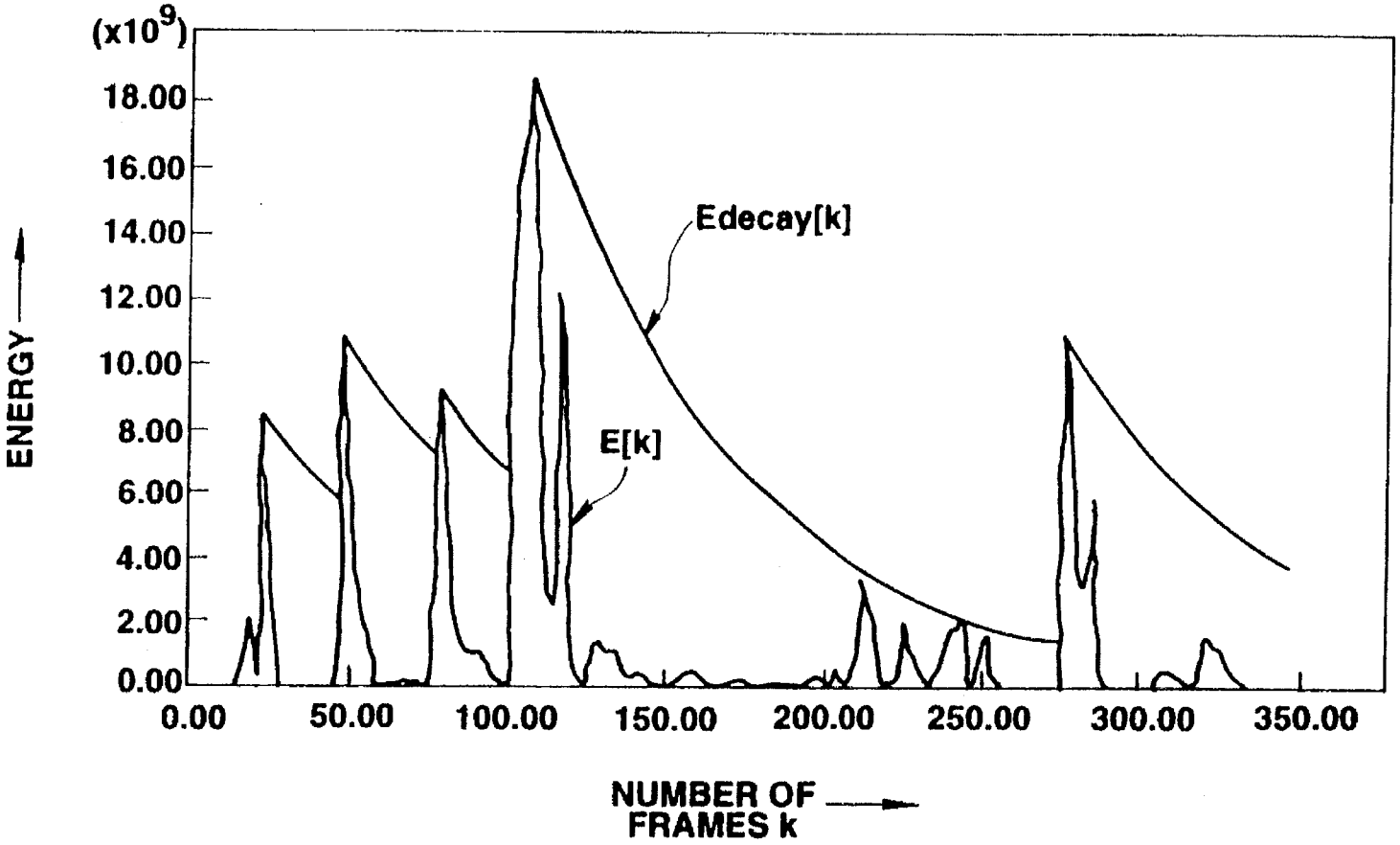
FIG. 3 is a graph showing illustrative examples of an energy E[k] and a decay energy $E_{decay}[k]$ in the embodiment shown in FIG. 1.

FIG. 3 shows illustrative examples of the energy E[k] and the decay energy $E_{decay}[k]$.

The minimum RMS calculating circuit 15C finds the minimum RMS value suitable for evaluating the background noise level. The free-based minimum short-term RMS values on the frame-basis and the minimum long-term RMS values, that is the minimum RMS values over plural frames, are found. The long-term values are used when the short-term values cannot track or follow significant changes in the noise level. The minimum short-term RMS noise value $\mathrm{MinNoise}_{short}$ is calculated by the following equation (7):

The minimum short-term RMS noise value $\mathrm{MinNoise}_{short}$ is set so as to be increased for the background noise, that is the surrounding noise free of speech. While the rate of rise for the high noise level is exponential, a fixed rise rate is employed for the low noise level for producing a higher rise rate.

The minimum long-term RMS noise value $\mathrm{MinNoise}_{long}$ is calculated for every 0.6 second. $\mathrm{MinNoise}_{long}$ is the minimum over the previous 1.8 second of frame RMS values which have $dB_{rel}>19$ dB. If in the previous 1.8 second, no RMS values have $dB_{rel}>19$ dB, then $\mathrm{MinNoise}_{long}$ is not used because the previous 1 second of signal may not contain any frames with only background noise. At each 0.6 second interval, if $\mathrm{MinNoise}_{long}>\mathrm{MinNoise}_{short}$, then $\mathrm{MinNoise}_{short}$ at that instance is set to $\mathrm{MinNoise}_{long}$.

The maximum signal calculating circuit 15D calculates the maximum RMS value or the maximum value of SNR (S/N ratio). The maximum RMS value is used for calculating the optimum or maximum SNR value. For the maximum RMS value, both the short-term and long-term values are calculated. The short-term maximum RMS value $\mathrm{MaxSignal}_{short}$ is found from the following equation (8):

$$\mathrm{MaxSignal}_{short}[k]=\max\left(\mathrm{RMS}[k],e^{-\frac{FL}{3.2\cdot FS}}\cdot\mathrm{MaxSignal}_{short}[k-1]\right) \tag{8}$$

The maximum long-term RMS noise value $\mathrm{MaxSignal}_{long}$ is calculated at an interval of e.g., 0.4 second. This value $\mathrm{MaxSignal}_{long}$ is the maximum value of the frame RMS value during the term of 0.8 second temporally forward of the current time point. If, during each of the 0.4 second domains, $\mathrm{MaxSignal}_{long}$ is smaller than $\mathrm{MaxSignal}_{short}$, $\mathrm{MaxSignal}_{short}$ is set to a value of $(0.7\cdot\mathrm{MaxSignal}_{short}+0.3\cdot\mathrm{MaxSignal}_{long})$.

Figure 4:
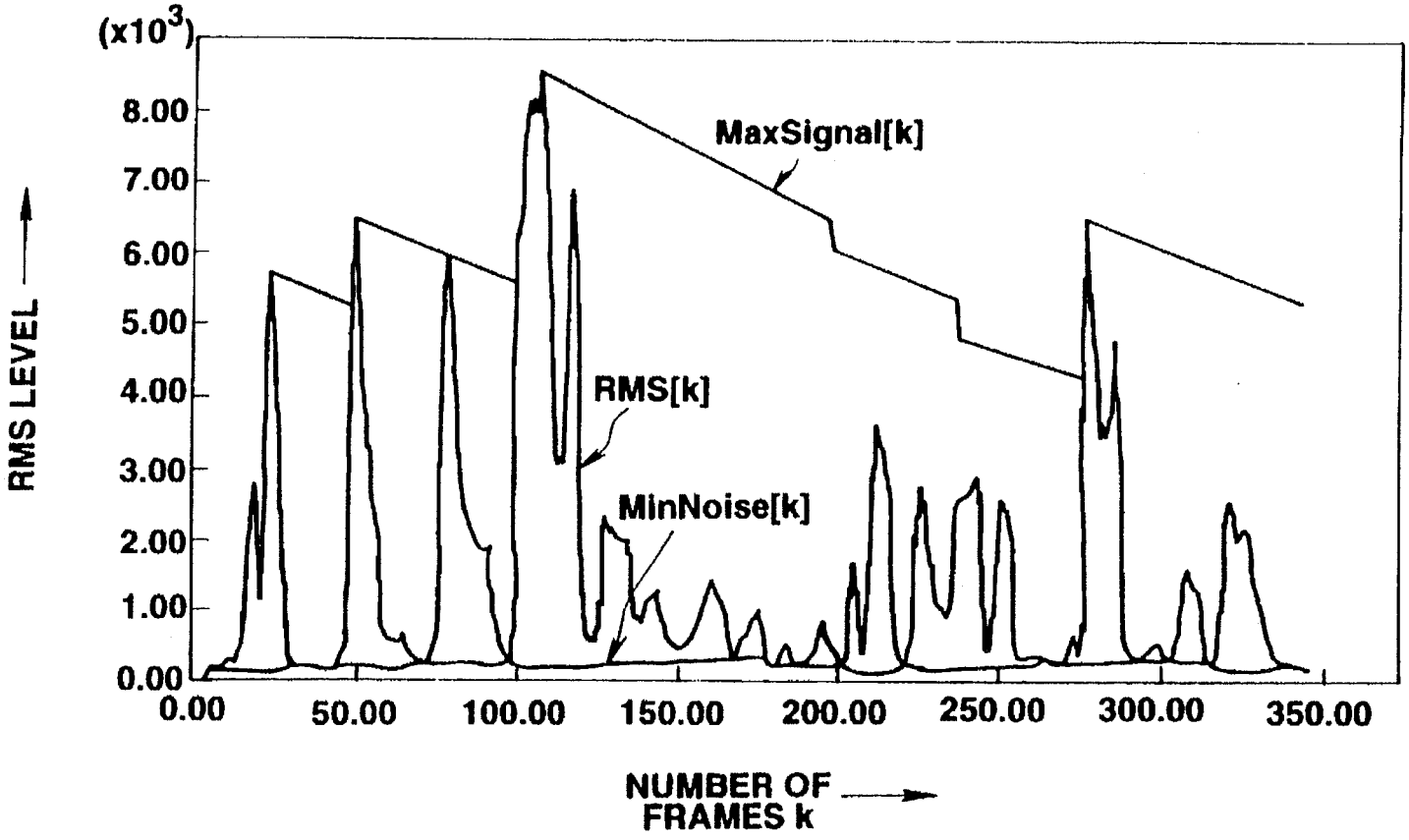
FIG. 4 is a graph showing illustrative examples of the short-term RMS value RMS[k], minimum noise RMS values MinNoise[k] and the maximum signal RMS values MaxSignal[k] in the embodiment shown in FIG. 1.

FIG. 4 shows illustrative values of the short-term RMS value RMS[k], minimum noise RMS value MinNoise[k] and the maximum signal RMS value MaxSignal[k]. In FIG. 4, the minimum noise RMS value MinNoise[k] denotes the short-term value of $\mathrm{MinNoise}_{short}$ which takes the long-term value $\mathrm{MinNoise}_{long}$ into account. Also, the maximum signal RMS value MaxSignal[k] denotes the short-term value of $\mathrm{MaxSignal}_{short}$ which takes the long-term value $\mathrm{MaxSignal}_{long}$ into account.

The maximum signal SNR value may be estimated by employing the short-term maximum signal RMS value $\mathrm{MaxSignal}_{short}$ and the short-term minimum noise RMS value $\mathrm{MinNoise}_{short}$. The noise suppression characteristics and threshold value for noise domain discrimination are modified on the basis of this estimation for reducing the possibility of distorting the noise-free clean speech signal. The maximum SNR value MaxSNR is calculated by the equation:

$$\mathrm{MinNoise}_{short}[k]=\min\left(\mathrm{RMS}[k],\max\left(\alpha(k)e^{\frac{FL}{0.8\cdot FS}}\mathrm{MinNoise}_{short}[k-1],\mathrm{MinNoise}_{short}[h-1]+5.0*\alpha(h)\right)\right) \tag{7}$$

$a(k)=1$ $\quad$ $\mathrm{RMS}[k]<\mathrm{MAX_NOISE_RMS}$, and $\mathrm{RMS}[k]<3\ \mathrm{MinNoise}_{short}[k-1]$ 0 $\quad$ otherwise $$\text{Max}SNR[k] = 20.0 \cdot \log_{10}\left(\frac{\max(1000.0, \text{MaxSignal}_{short}[k])}{\max(0.5, \text{MinNoise}_{short}[k])} - 1.0\right) \quad (9)$$

From the value MaxSNR, the normalized parameter NR_level in a range of from 0 to 1 indicating the relative noise level is calculated. The following NT_level function is employed.

$$NR_\text{level}[k] = \left(\frac{1}{2} + \frac{1}{2}\cos\left(\pi \cdot \frac{\text{Max}SNR[k] - 30}{20}\right)\right) \times (1 - 0.002\,(\text{Max}SNR[K] - 30)^2) \quad (10)$$

Figure 5:
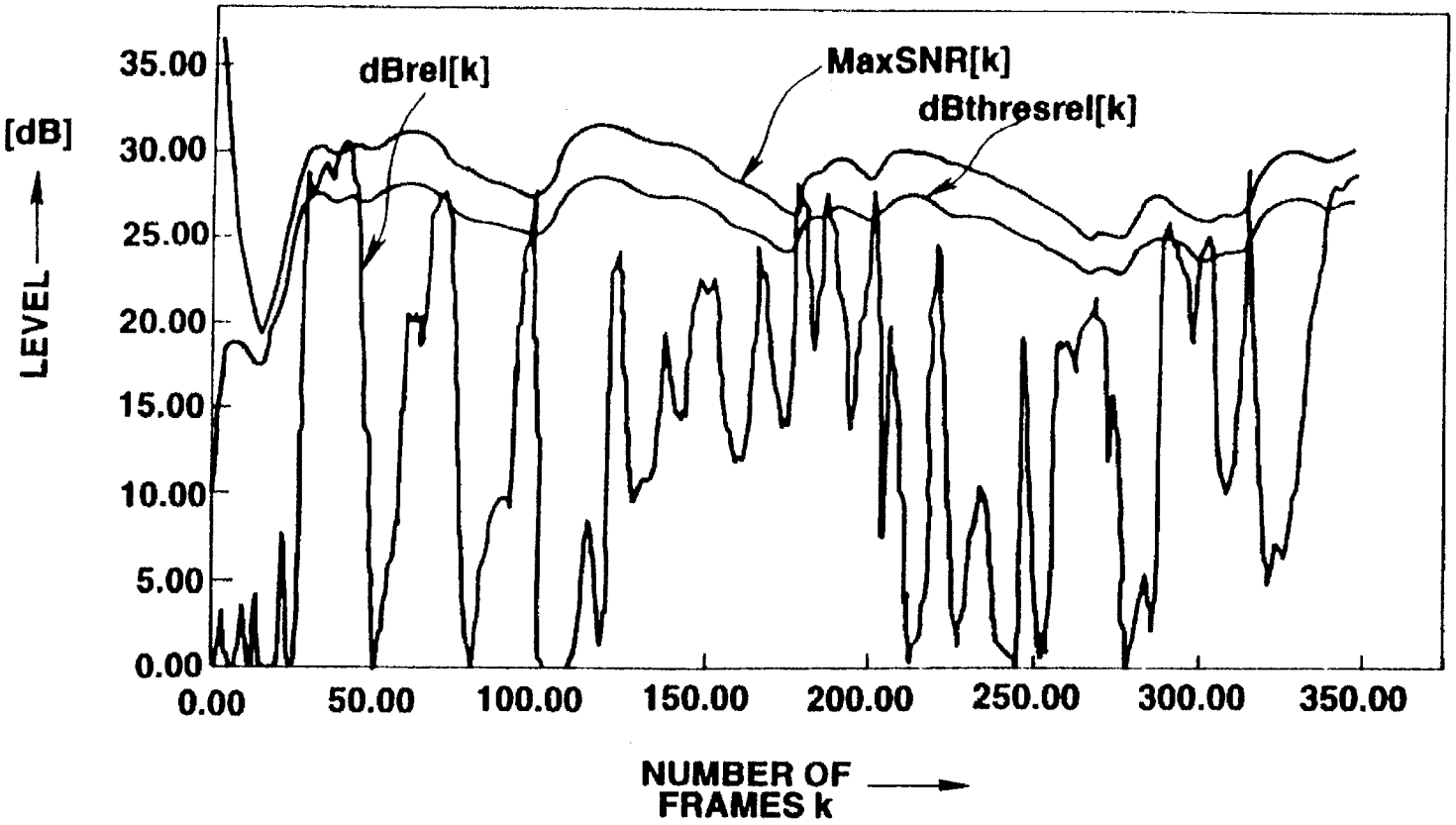
FIG. 5 is a graph showing illustrative examples of the relative energy in dB $dB_{rel}[k]$, maximum SNR value MaxSNR[k] and $dBthres_{rel}[k]$ as one of threshold values for noise discrimination.
Figure 6:
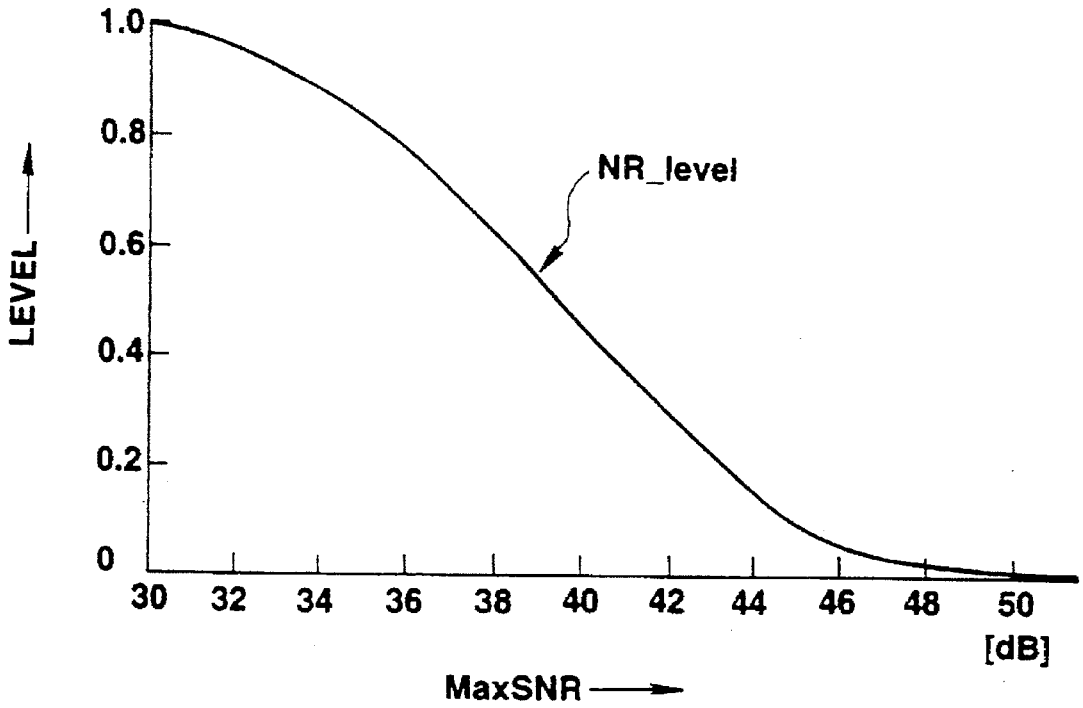
FIG. 6 is a graph for illustrating NR level[k] as a function defined with respect to the maximum SNR value MaxSNR [k] in the embodiment shown in FIG. 1.
Figure 7:
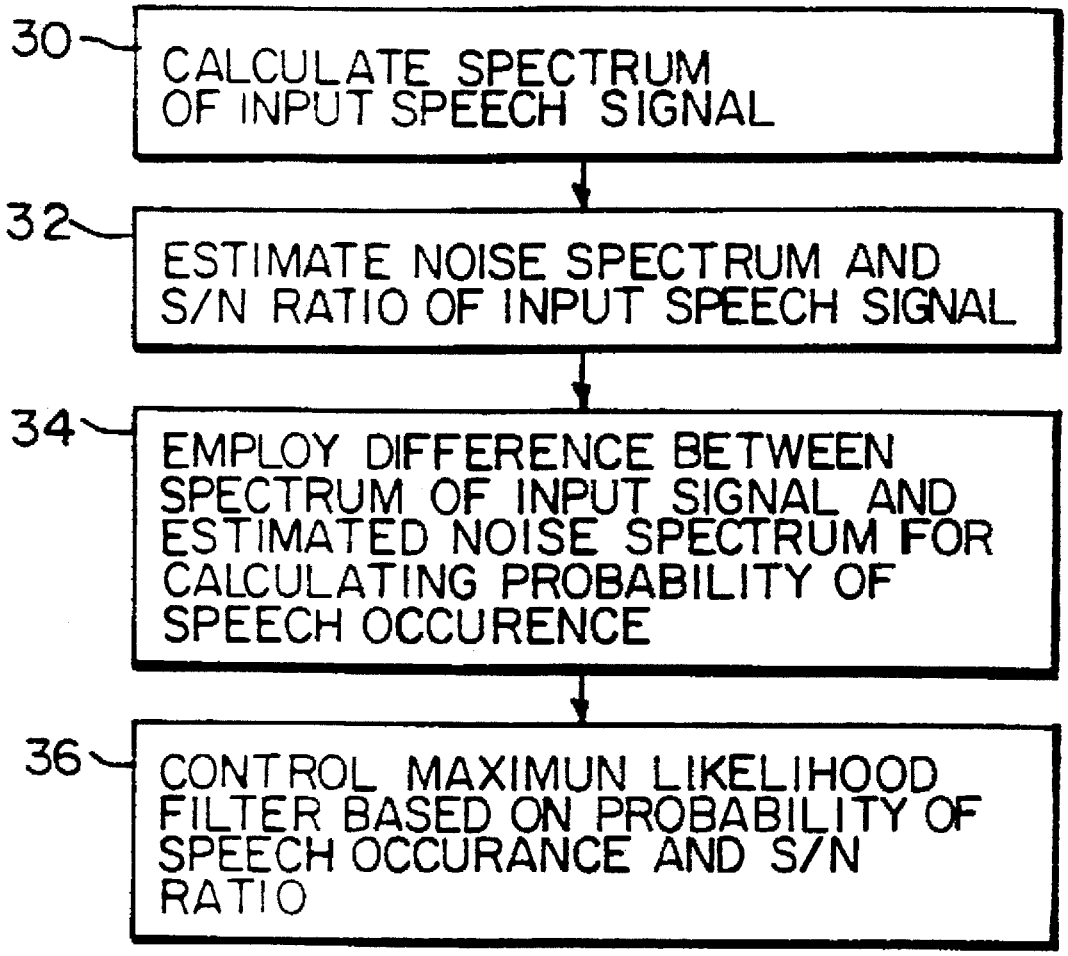
FIG. 7 is a flow chart describing the method steps according to an embodiment of the present invention.

$30 < \text{Max}SNR[k] \leqq 50$ $0.0 \quad \text{Max}SNR[k] > 50$ $1.0 \quad \text{otherwise}$ The operation of the noise spectrum estimation circuit 15E is explained. The values calculated by the relative energy calculating circuit 15B, minimum RMS calculating circuit 15C and by the maximum signal calculating circuit 15D are used for distinguishing the speech from the background noise. If the following conditions are met, the signal in the k'th frame is classified as being the background noise.

$$((\text{RMS}[k] < \text{NoiseRMS}_{thres}[k]) \text{ or } (dB_{rel}[k] > dBthres_{rel}[k])) \text{ and } (\text{RMS}[k] < \text{RMS}[k-1] + 200) \quad (11)$$

where $\text{NoiseRMS}_{rel}[k] = \min(1.05 + 0.45 \cdot NR_\text{level}[k])$ $\text{MinNoise}[k], \text{MinNoise}[k] + \text{Max_}\Delta\text{_NOISE_RMS})$ $dBthres_{rel}[k] = \max(\text{Max}SNR[k] - 4.0, 0.9 \cdot \text{Max}SNR[k])$ FIG. 5 shows illustrative values of the relative energy $dB_{rel}[k]$, maximum SNR value MaxSNR[k] and the value of $dBthres_{rel}[k]$, as one of the threshold values of noise discrimination, in the above equation (11).

Figure 8:
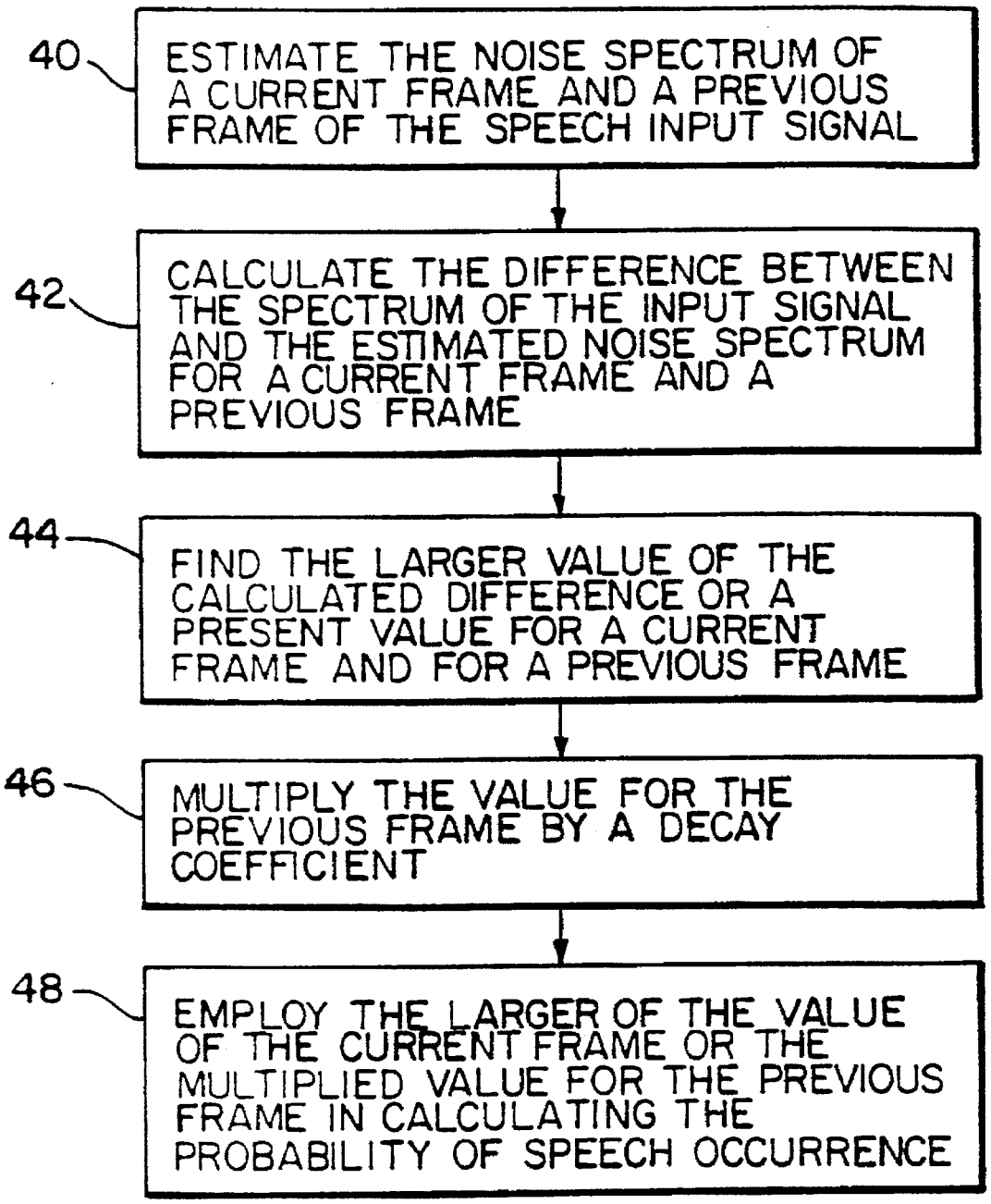
FIG. 8 is a flow chart describing the method steps according to another embodiment of the present invention
Figure 9:
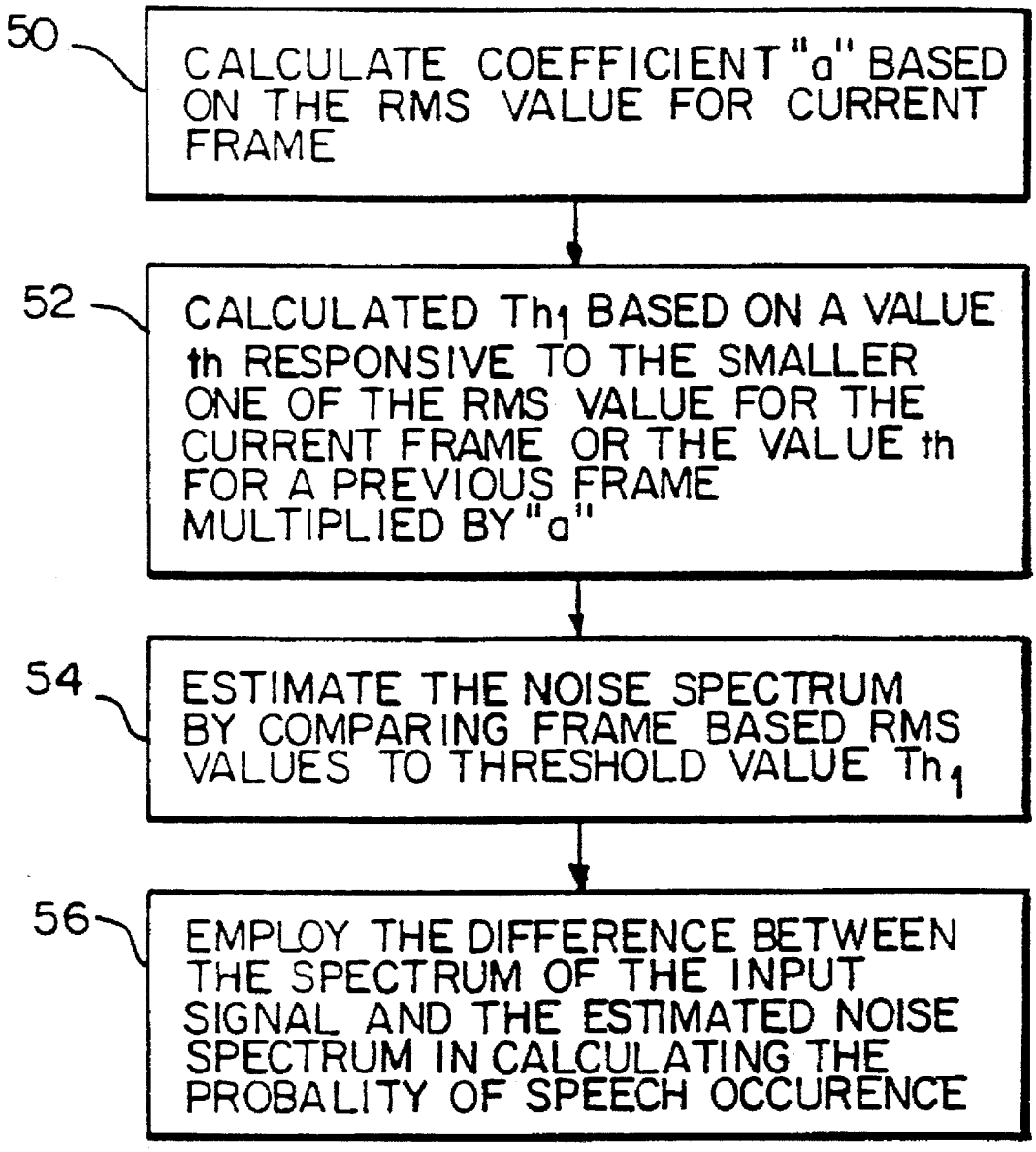
FIG. 9 is a flow chart describing the method steps according to another embodiment of the present invention.

FIG. 8 shows NR_level[k] as a function of MaxSNR[k] in the equation (10).

If the k'th frame is classified as being the background noise or the noise, the time averaged estimated value of the noise spectrum Y[w, k] is updated by the signal spectrum Y[w, k] of the current frame, as shown in the following equation (12):

$$N[w,k] = a \cdot \max(N[w,k-1], Y[w,k]) + (1-a) \cdot \min(N[w,k-1], Y[w,k]) \quad (12)$$

$$\alpha = e^{-\frac{FL}{0.5 \cdot FS}}$$

where w denotes the band number for the frequency band splitting.

If the k'th frame is classified as the speech, the value of N[w, k–1] is directly used for N[w, k].

Figure 2:
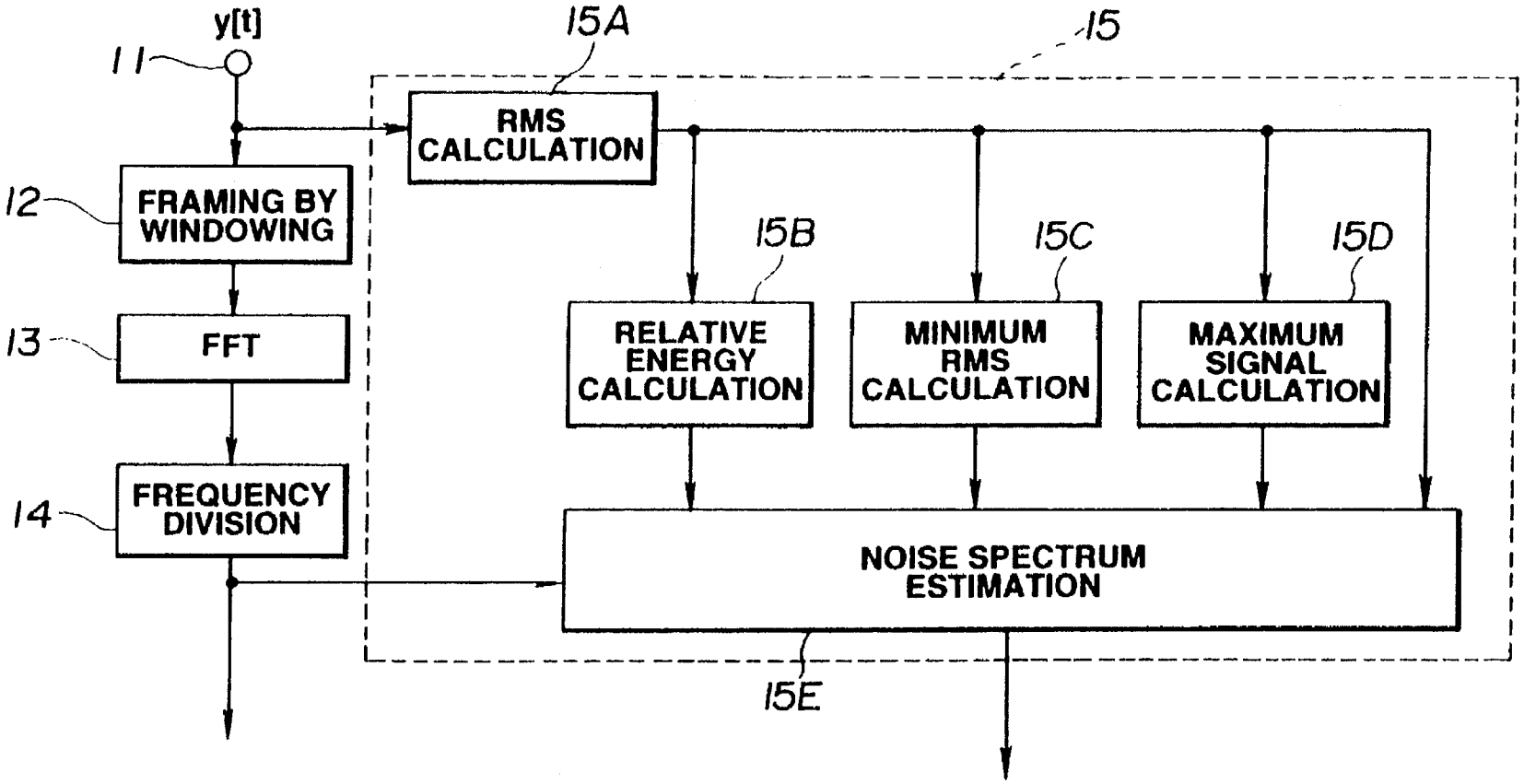
FIG. 2 is a block circuit arrangement showing an illustrative example of a noise estimating circuit employed in the embodiment shown in FIG. 1.

An output of the noise estimation circuit 15 shown in FIG. 2 is transmitted to a speech estimation circuit 16 shown in FIG. 1, a Pr(Sp) calculating circuit 17, a Pr(Sp|Y) calculating circuit 18 and to a maximum likelihood filter 19.

In carrying out arithmetic-logical operations in the noise spectrum estimation circuit 15E of the noise estimation circuit 15, the arithmetic-logical operations may be carried out using at least one of output data of the relative energy calculating circuit 15B, minimum RMS calculating circuit 15C and the maximum signal calculating circuit 15D. Although the data produced by the estimation circuit 15E is lowered in accuracy, a smaller circuit scale of the noise estimation circuit 15 suffices. Of course, high-accuracy output data of the estimation circuit 15E may be produced by employing all of the output data of the three calculating circuits 15B, 15C and 15D. However, the arithmetic-logical operations by the estimation circuit 15E may be carried out using outputs of two of the calculating circuits 15B, 15C and 15D.

The speech estimation circuit 16 calculates the SN ratio on the band basis. The speech estimation circuit 16 is fed with the spectral amplitude data Y[w, k] from the frequency band splitting circuit 14 and the estimated noise spectral amplitude data from the noise estimation circuit 15. The estimated speech spectral data S[w, k] is derived based upon these data. A rough estimated value of the noise-free clean speech spectrum may be employed for calculating the probability Pr(Sp|Y) as later explained. This value is calculated by taking the difference of spectral values in accordance with the following equation (13).

$$S'[w,k] = \sqrt{\max(0, Y[w,k]^2 - \rho \cdot N[w,k]^2)} \quad (13)$$

Then, using the rough estimated value S'[w, k] of the speech spectrum as calculated by the above equation (13), an estimated value S[w, k] of the speech spectrum, time-averaged on the band basis, is calculated in accordance with the following equation (14):

$$S[w,k] = \max(S'[w,k], S'[w,k-1] \cdot \text{decay_rate}) \quad (14)$$

$$\text{decay}_{rate} = e^{\frac{-PL}{(4-0.5 \cdot nr_{level}) \cdot FS}}$$

In the equation (14), the decay_rate shown therein is employed.

The band-based SN ratio is calculated in accordance with the following equation (15):

$$SNR[w,k] = 20 \cdot \log_{10}\left(\frac{0.2 \cdot S[w-1,k] + 0.6 \cdot S[w,k] + 0.2S[w+1,k]}{0.2 \cdot N[w+1,k] + 0.6 \cdot N[w,k] + 0.2N[w-1,k]}\right) \quad (15)$$

where the estimated value of the noise spectrum N[ ] and the estimated value of the speech spectrum may be found from the equations (12) and (14), respectively.

The operation of the Pr(Sp) calculating circuit 17 is explained. The probability Pr(Sp) is the probability of the speech signals occurring in an assumed input signal. This probability was hitherto fixed perpetually to 0.5. For a signal having a high SN ratio, the probability Pr(Sp) can be increased for prohibiting sound quality deterioration. Such probability Pr(Sp) may be calculated in accordance with the following equation (16):

$$Pr(Sp) = 0.5 + 0.45 \cdot (1.0 - NR_\text{level}) \quad (16)$$

using the NR_level function calculated by the maximum signal calculating circuit 15D.

The operation of the Pr(Sp|Y) calculating circuit 18 is now explained. The value Pr(Sp|Y) is the probability of the speech signal occurring in the input signal y[t], and is calculated using Pr(Sp) and SNR[w, k]. The value Pr(Sp|Y) is used for reducing the speech-free domain to a narrower value. For calculations, the method disclosed in R. J. McAulay and M. L. Malpass, Speech Enhancement Using a Soft-Decision Noise Suppression Filter, IEEE Trans. Acoust, Speech, and Signal Processing, Vo. ASSP-28, No.2, April 1980, which is now explained by referring to equations (17) to (20), was employed.

$$Pr(H1|Y)[w,k] = \frac{Pr(H1)\cdot p(Y|H1)}{Pr(H1)\cdot p(Y|H1) + Pr(H0)\cdot p(Y|H0)} \quad (17)$$

(Bayes Rule)

$$p(Y|H0) = \frac{2\cdot Y}{\sigma}\cdot e^{-\frac{Y^2}{\sigma}} \quad (18)$$

(Rayleigh *pdf*)

$$p(Y|H1) = \frac{2\cdot Y}{\sigma}\cdot e^{-\frac{Y^2+S^2}{\sigma}}\cdot I_0\left(\frac{2\cdot S\cdot Y}{\sigma}\right) \quad (19)$$

(Rician *pdf*)

$$I_0(|x|) = \frac{1}{2\pi}\int_0^{2\pi} e^{R\alpha(e^{-j\theta})}d\theta \quad (20)$$

(modified Bessel function of 1st kind)

In the above equations (17) to (20), HO denotes a non-speech event, that is the event that the input signal y(t) is the noise signal n(t), while H1 denotes a speech event, that is the event that the input signal y(t) is a sum of the speech signal s(t) and the noise signal n(t) and s(t) is not equal to 0. In addition, w, k, Y, S and σ denote the band number, frame number, input signal [w, k], estimated value of the speech signal S[w, k] and a square value of the estimated noise signal $N[w, k]^2$, respectively.

Pr(H1~Y)[w, k] is calculated from the equation (17), while p(Y|HO) and p(Y|H1) in the equation (17) may be found from the equation (19). The Bessel function $I_0(|X|)$ is calculated from the equation (20).

The Bessel function may be approximated by the following function (21):

$$I_0(|x|) = \begin{cases} \frac{1}{\sqrt{2\pi|x|}}\cdot e^{|x|} + 0.07, & \text{if } |x| \geqq 0.5 \\ 1 & \text{otherwise} \end{cases} \quad (21)$$

Heretofore, a fixed value of the SN ratio, such as SNR=5, was employed for deriving Pr(H1|Y) without employing the estimated speech signal value S[w, k]. Consequently, p(Y|H1) was simplified as shown by the following equation (22):

$$p(Y|H1) = \frac{2}{\sigma}\cdot e^{-\frac{Y^2}{\sigma}-SNR^2}\cdot I_0\left(2\cdot SNR\cdot\frac{Y}{\sqrt{\sigma}}\right) \quad (22)$$

A signal having an instantaneous SN ratio lower than the value SNR of the SN ratio employed in the calculation of p(Y|H1) is suppressed significantly. If it is assumed that the value SNR of the SN ratio is set to an excessively high value, the speech corrupted by a noise of a lower level is excessively lowered in its low-level speech portion, so that the produced speech becomes unnatural. Conversely, if the value SNR of the SN ratio is set to an excessively low value, the speech corrupted by the larger level noise is low in suppression and sounds noisy even at its low-level portion. Thus the value of p(Y|H1) conforming to a wide range of the background/speech level is obtained by using the variable value of the SN ratio $SNR_{new}[w, k]$ as in the present embodiment instead of by using the fixed value of the SN ratio. The value of $SNR_{new}[w, k]$ may be found from the following equation (23):

$$SNR_{new}[w,k] = \max(\text{MIN_}SNR(SNR[w,k]), \frac{S[w,k]}{N[w,k]} \quad (23)$$

in which the value of MIN_SNR is found from the equation (24):

$$\text{MIN_}SNR(x) = \begin{cases} 3, & x < 10 \\ 3 - \frac{x+10}{35}\cdot 1.5, & 10 \leqq x \leqq 45 \\ 1.5, & \text{otherwise} \end{cases} \quad (24)$$

The value $SNR_{new}[w, k]$ is an instantaneous SNR in the k'th frame in which limitation is placed on the minimum value. The value of $SNR_{new}[w, k]$ may be decreased to 1.5 for a signal having the high SN ratio on the whole. In such case, suppression is not done on segments having low instantaneous SN ratio. The value $SNR_{new}[w, k]$ cannot be lowered to below 3 for a signal having a low instantaneous SN ratio as a whole. Consequently, sufficient suppression may be assured for segments having a low instantaneous S/N ratio.

The operation of the maximum likelihood filter 19 is explained. The maximum likelihood filter 19 is one of pre-filters provided for freeing the respective bands of the input signal of noise signals. In the maximum likelihood filter 19, the spectral amplitude data Y[w, k] from the frequency band splitting filter 14 is converted into a signal H[w, k] using the noise spectral amplitude data N[w, k] from the noise estimation circuit 15. The signal H[w, k] is calculated in accordance with the following equation (25):

$$H[w,k] = \begin{cases} a + (1-a)\cdot\frac{(Y^2-N^2)^{1/2}}{Y}, & Y > 0 \text{ and } Y \geqq N \\ a, & \text{otherwise} \end{cases} \quad (25)$$

where α=0.7−0.4·NR_level[k].

Although the value α in the above equation (25) is conventionally set to ½, the degree of noise suppression may be varied depending on the maximum SNR because an approximate value of the SNR is known.

The operation of a soft decision suppression circuit 21 is now explained. The soft decision suppression circuit 20 is one of pre-filters for enhancing the speech portion of the signal. Conversion is done by the method shown in the following equation (26) using the signal H[w, k] and the value Pr(H1|Y) from the Pr(Sp|Y) calculating circuit 18:

$$H[w,k] \leftarrow Pr(H1|Y)[w,k]\cdot H[w,k] + (1 - Pr(H1|Y[w,k]\cdot \text{MIN_GAIN})) \quad (26)$$

In the above equation (26), MIN_GAIN is a parameter indicating the minimum gain, and may be set to, for example, 0.1, that is −15 dB.

The operation of a filter processing circuit 21 is now explained. The signal H[w, k] from the soft decision suppression circuit 20 is filtered along both the frequency axis and the time axis. The filtering along the frequency axis has the effect of shortening the effective impulse response length of the signal H[w, k]. This eliminates any circular convolution aliasing effects associated with filtering by multiplication in the frequency domain. The filtering along the time axis has the effect of limiting the rate of change of the filter in suppressing noise bursts.

The filtering along the frequency axis is now explained. Median filtering is done on the signals H[w, k] of each of 18 bands resulting from frequency band division. The method is explained by the following equations (27) and (28):

$$\text{Step 1: } H1[w,k] = \max(\text{median}(H[w-1,k], H[w,k], H[w+1,k], H[w,k])) \quad (27)$$

where H1[w, k]=H[w, k] if (w−1) or (w+1) is absent $$\text{Step 2: } H2[w,k] = \min(\text{median}(H[w-1,k], H[w,k], H[w+1,k], H[w,$$

$k]))$ (27)

where H2[w, k]=H1[w, k] if (w−1) or (w+1) is absent.

In the step 1, H1[w, k] is H[w, k] without single band nulls. In the step 2, H2[w, k] is H1[w,k] without sole band spikes. The signal resulting from filtering along the frequency axis is H2[w, k].

Next, the filtering along the time axis is explained. The filtering along time axis considers three states of the input speech signal, namely the speech, the background noise and the transient which is the rising portion of the speech. The speech signal is smoothed along the time axis as shown by the following equation (29).

$$H_{speech}[w, k]=0.7\cdot H2[w, k]+0.3\cdot H2[w, k-1] \quad (29)$$

The background noise signal is smoothed along the time axis as shown by the following equation (30):

$$H_{noise}[w, k]=0.7\cdot \text{Min_}H+0.3\cdot \text{Max_}H \quad (30)$$

where

Min_H and Max_H are:

Min_H=min(H2[w, k], H2[w, k−1])

Max_H=max(H2[w, k], H2[w, k−1])

For transient signals, no smoothing on time axis is not performed. Ultimately, calculations are carried out for producing the smoothed output signal $H_{t_smooth}[w, k]$ by the following equation (31):

$$H_{t_smooth}[w, k]=(1-\alpha_{tr})(\alpha_{sp}\cdot H_{speech}[w, k]+(1-\alpha_{sp})\cdot H_{noise}[w, k]+\alpha_{tr}\cdot H2[w, k]) \quad (31)$$

$\alpha_{sp}$ and $\alpha_{tr}$ in the equation (31) are respectively found from the equations (32) and (33):

$$\alpha_{sp}=\begin{cases}1.0, & SNR_{inst}>4.0\\ (SNR_{inst}-1)\cdot\frac{1}{3}, & 1.0<SNR_{inst}<4.0\\ 0, & \text{otherwise}\end{cases} \quad (32)$$

where $$SNR_{inst}=\frac{RMS[k]}{\text{MinNoise}[k]}$$

$$\alpha_{tr}=\begin{cases}1.0, & \delta_{rms}>3.5\\ (\delta_{rms}-2)\cdot\frac{2}{3}, & 2.0<\delta_{rms}<3.5\\ 0, & \text{otherwise}\end{cases} \quad (33)$$

where $$\delta_{rms}=\frac{RMS_{local}[k]}{RMS_{local}[k-1]},\ RMS_{local}[k]=\sqrt{\frac{1}{FI}\cdot\sum_{t=FI/2}^{FL-FI/2}y^2[t]}$$

The operation in a band conversion circuit 22 is explained. The 18 band signals $H_{t_smooth}[w, k]$ from the filtering circuit 21 is interpolated to e.g., 128 band signals $H_{128}[w, k]$. The interpolation is done in two stages, that is, the interpolation from 18 to 64 bands is done by zero-order hold and the interpolation from 64 to 128 bands is done by a low-pass filter interpolation.

The operation in a spectrum correction circuit 23 is explained. The real part and the imaginary part of the FFT coefficients of the input signal obtained at the FFT circuit 13 are multiplied with the above signal $H_{128}[w, k]$ to carry out spectrum correction. The result is that the spectral amplitude is corrected, while the spectrum is not modified in phase.

An IFFT circuit 24 executes inverse FFT on the signal obtained at the spectrum correction circuit 23.

An overlap-and-add circuit 25 overlap and adds the frame boundary portions of the frame-based IFFT output signals. A noise-reduced output signal is obtained at an output terminal 26 by the procedure described above.

The output signal thus obtained is transmitted to various encoders of a portable telephone set or to a signal processing circuit of a speech recognition device. Alternatively, decoder output signals of a portable telephone set may be processed with noise reduction according to the present invention.

The present invention is not limited to the above embodiment. For example, the above-described filtering by the filtering circuit 21 may be employed in the conventional noise suppression technique employing the maximum likelihood filter. The noise domain detection method by the filter processing circuit 15 may be employed in a variety of devices other than the noise suppression device.

What is claimed is:

1. A method for reducing noise in an input speech signal in which noise suppression is done by adaptively controlling a maximum likelihood filter adapted for calculating speech components based on a probability of speech occurrence, wherein the improvement comprises the steps of:

calculating a spectrum of said input speech signal;

estimating a noise spectrum and a signal to-noise ratio of said input signal;

employing a difference between said spectrum of said input speech signal and said estimated noise spectrum in calculating said probability of speech occurrence; and controlling said maximum likelihood filter using said calculated probability of speech occurrence and said signal-to-noise ratio.

2. The method as claimed in claim 1, wherein the larger of the value of said difference or a pre-set value is employed for calculating the probability of speech occurrence.

3. A method for reducing noise in an input speech signal in which noise suppression is done by adaptively controlling a maximum likelihood filter adapted for calculating speech components based on a probability of speech occurrence, wherein the improvement comprises the steps of:

estimating the noise spectrum of an input signal;

calculating a difference between a spectrum of an input signal and said estimated noise spectrum;

finding the larger value of said difference or a pre-set value for a current frame and for a previous frame;

multiplying the value for the previous frame by a pre-set decay coefficient; and employing the larger of the value for the current frame or the value for the previous frame multiplied by the pre-set decay coefficient for calculating the probability of speech occurrence.

4. The method as claimed in claim 1, further including the step of processing characteristics of said maximum likelihood filter with smoothing filtering along a frequency axis and along a time axis, wherein said smoothing filtering along said frequency axis is performed using a median value of said characteristics in the frequency range under consideration and in the neighboring left and right frequency ranges.

5. A method for reducing noise in an input speech signal in which noise suppression is done by adaptively controlling a maximum likelihood filter adapted for calculating speech components based on a probability of speech occurrence, wherein the improvement comprises the steps of:

estimating the noise spectrum of an input signal;

employing a difference between a spectrum of an input signal and said estimated noise spectrum in calculating the probability of speech occurrence, wherein the step of estimating the noise spectrum estimates the noise spectrum by comparing frame-based root-mean-square values to a threshold value $Th_1$, a value th for finding the threshold value $Th_1$ is found responsive to the smaller one of the root-mean-square value for the current frame or the value th of the previous frame multiplied with a coefficient a, and the coefficient a is changed over depending on the root-mean-square value for the current frame.

6. The method as claimed in claim 5, wherein the value th for finding the threshold value $Th_1$ is found by employing the larger one of: the root-mean-square value of the current frame or the value th of the previous frame multiplied by a coefficient $\alpha$, whichever is smaller, or the minimum value of the root-mean-square values over a plurality of frames.

7. The method as claimed in claim 6, wherein the noise spectrum estimation is done by discriminating the relative energy of the current frame using a threshold value $Th_2$ calculated using the maximum signal-to-noise ratio of the input speech signal.

* * * * *